US006817445B2

(12) United States Patent
Slemmer

(10) Patent No.: US 6,817,445 B2
(45) Date of Patent: Nov. 16, 2004

(54) ADJUSTABLE SAWHORSE WITH TWO SUPPORT MEMBERS

(76) Inventor: Robert K. Slemmer, P.O. Box 193, McCutchenville, OH (US) 44844

( * ) Notice: Subject to any disclaimer, the term of this patent is extended or adjusted under 35 U.S.C. 154(b) by 0 days.

(21) Appl. No.: 10/395,117

(22) Filed: Mar. 25, 2003

(65) Prior Publication Data

US 2004/0188178 A1 Sep. 30, 2004

(51) Int. Cl.[7] ..... E04G 1/34
(52) U.S. Cl. ..... 182/154; 182/153
(58) Field of Search ..... 182/154, 153, 182/31, 152, 155, 151, 181.1, 225, 224, 186.1, 186.2, 186.5, 182.4, 182.5; 248/164; 108/118

(56) References Cited

U.S. PATENT DOCUMENTS

| | | | | |
|---|---|---|---|---|
| 295,269 A | * | 3/1884 | Miller | 182/153 |
| 296,209 A | * | 4/1884 | Nelson | 182/181.1 |
| 3,157,136 A | | 11/1964 | Moody | |
| 4,819,762 A | | 4/1989 | Osborne, Sr. | |
| 4,974,525 A | | 12/1990 | Sheffield | |
| 5,657,703 A | | 8/1997 | Johnson | |
| 5,927,436 A | | 7/1999 | Schutz | |
| 6,314,893 B1 | | 11/2001 | Lee | |
| 6,536,359 B2 | * | 3/2003 | Liu | 108/118 |
| 2002/0011381 A1 | | 1/2002 | Wilkerson | |

FOREIGN PATENT DOCUMENTS

| | | |
|---|---|---|
| GB | 2 137 490 A | 10/1984 |

* cited by examiner

*Primary Examiner*—Hugh B. Thompson, II
(74) *Attorney, Agent, or Firm*—Richard C Litman

(57) ABSTRACT

An adjustable sawhorse that functions as two sawhorses by providing two support members positioned several feet apart. The device is comprised of two rectangular framed leg assemblies that are pivotally attached and operate with a scissor-like motion. Each rectangular framed leg assembly is comprised of a first and second "U" shaped tubular member with the first "U" shaped tubular member having a smaller diameter than that of the second, and with the sides of the first "U" shaped tubular member being slidably mounted inside the sides of the second. The second "U" shaped tubular member of each leg assembly includes two locking knobs to lock the first and second "U" shaped tubular members into place with respect to each other. The device includes two chains interlinking the two rectangular framed leg assemblies and a support member pivotally attached to the uppermost cross bar of each leg assembly.

7 Claims, 9 Drawing Sheets

ADJUSTABLE SAWHORSE WITH TWO SUPPORT MEMBERS

BACKGROUND OF THE INVENTION

1. Field of the Invention

The present invention relates to sawhorses, and more particularly, to a single sawhorse having two separate support members that allow it to function as two sawhorses.

2. Description of the Related Art

Sawhorses are well known in the art and an example of one is provided by FIG. 1C of U.S. Pat. App. Pub. No. US2002/0011381. One of the most common uses of sawhorses is to support building materials during a construction project. Typically, the building materials are placed on the support members of two-sawhorses which are spaced a few feet apart with the two support members positioned in parallel. For example, when painting a strip of crown molding, a carpenter would place one end of the crown molding on the support member of one sawhorse and the other end of the crown molding on the support member of a second sawhorse. This would provide a raised support for the crown molding while allowing the carpenter to move freely around the crown molding while painting it. Sawhorses can be used in a similar manner to support other materials such as sheets of plywood or sheetrock and equipment such as a power miter saw.

The use of traditional sawhorses has at least two well-known drawbacks. First, traditional sawhorses are bulky and require significant amounts of space to both store and transport. And second, two traditional sawhorses are required to properly support a piece of building material.

Collapsible or foldable sawhorses such as those depicted in U.S. Pat. Nos. 4,819,762 and 5,927,436 to Osborne and Schutz, respectively, and in U.S. Pat. App. Pub. No. US2002/0011381 to Wilkerson have been introduced to reduce the space requirements of storing and transporting sawhorses. However, these collapsible or foldable sawhorses are generally more expensive than traditional sawhorses and thereby add to the expense of using sawhorses. Additionally, they require set-up time to unfold and are configured such that folding or unfolding often results in pinched fingers. Furthermore, they are not adjustable in height or width. Structurally, these sawhorses do not resemble the present invention.

Although, the prior art does not disclose a single sawhorse having two support members that serves the function of two sawhorses, it does disclose some workstations and other items that bear faint structural resemblances to the present invention. For example, U.S. Pat. No. 3,157,136 to Moody, U.S. Pat. No. 6,314,893 to Lee, and United Kingdom Pat. No. GB2,137,490, disclose respectively a folding support stand, a cutting machine table, and a baby care table. These devices are similar to the present invention in that each includes two sets of legs that open and close in a scissor-like motion. However, unlike the present invention, none of these devices is adjustable in height or width, nor includes cross-linked chains for added strength and stability.

Similarly, although the devices disclosed in U.S. Pat. No. 4,974,525 to Sheffield and U.S. Pat. No. 5,657,703 to Johnson include two sets of legs that open and close in a scissors-like motion and also include cross-linked chains, both of the devices differ structurally from the present invention in at least two respects. First neither of the devices is height adjustable and, second, neither of the devices' support member or members can be easily replaced with an inexpensive material such as a segment of two-by-four wood. Additionally, the Johnson device is complex in its configuration and, hence, is more expensive to manufacture.

Wherefore, none of the above inventions and patents, taken either singly or in combination, is seen to describe the instant invention as claimed and, thus, an adjustable sawhorse with two support members solving the aforementioned problems is desired.

SUMMARY OF THE INVENTION

The present invention is an adjustable sawhorse that functions as two sawhorses by providing two support members positioned several feet apart. The device is collapsible and can be adjusted to different heights and widths.

The device is comprised of two rectangular framed leg assemblies that are pivotally attached and operate with a scissors-like motion. Each leg assembly is comprised of a first and second "U" shaped tubular member with the first "U" shaped tubular member having a smaller diameter than that of the second, and with the sides of the first "U" shaped tubular member being slidably mounted inside the sides of the second. The second "U" shaped tubular member of each leg assembly includes two locking knobs to lock the first and second "U" shaped tubular members into place with respect to each other. The device includes two chains interlinking the two rectangular framed leg assemblies and a support member pivotally attached to the uppermost cross bar of each leg assembly. The device also includes a separate fastening strap to secure the device in its collapsed position.

The height and width of the device can be adjusted by either adjusting the length of the interlinking chains or by adjusting the size of each of the rectangular framed leg assemblies. The size of the leg assemblies are adjusted by sliding the first "U" shaped tubular member further into or out of the second "U" shaped tubular member.

The fastening strap is made of hook and loop fastening material. The support members are constructed of segments of two-by-four wood and can be easily replaced if damaged. All other components are constructed of galvanized steel.

Accordingly, it is a principal object of the invention to eliminate the need for two separate sawhorses when supporting building materials or equipment and to thereby reduce the costs associated with sawhorses.

It is another object of the invention to provide a sawhorse that is easily stored and transported.

It is a further object of the invention to provide a sawhorse with two support members wherein the height and spacing of the support members can be adjusted.

Still another object of the invention is to provide a sawhorse that incorporates two chains and four cross bars for stability.

Additionally, another object of the invention is to provide a sawhorse that incorporates two support members that, when damaged, can be easily replaced with commercially available materials.

Further, another object of the invention is to provide an adjustable and collapsible sawhorse that can be readily and easily opened, collapsed and adjusted.

Furthermore, another object of the invention is to provide a sawhorse with a minimal number of components that is simple and inexpensive to manufacture.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
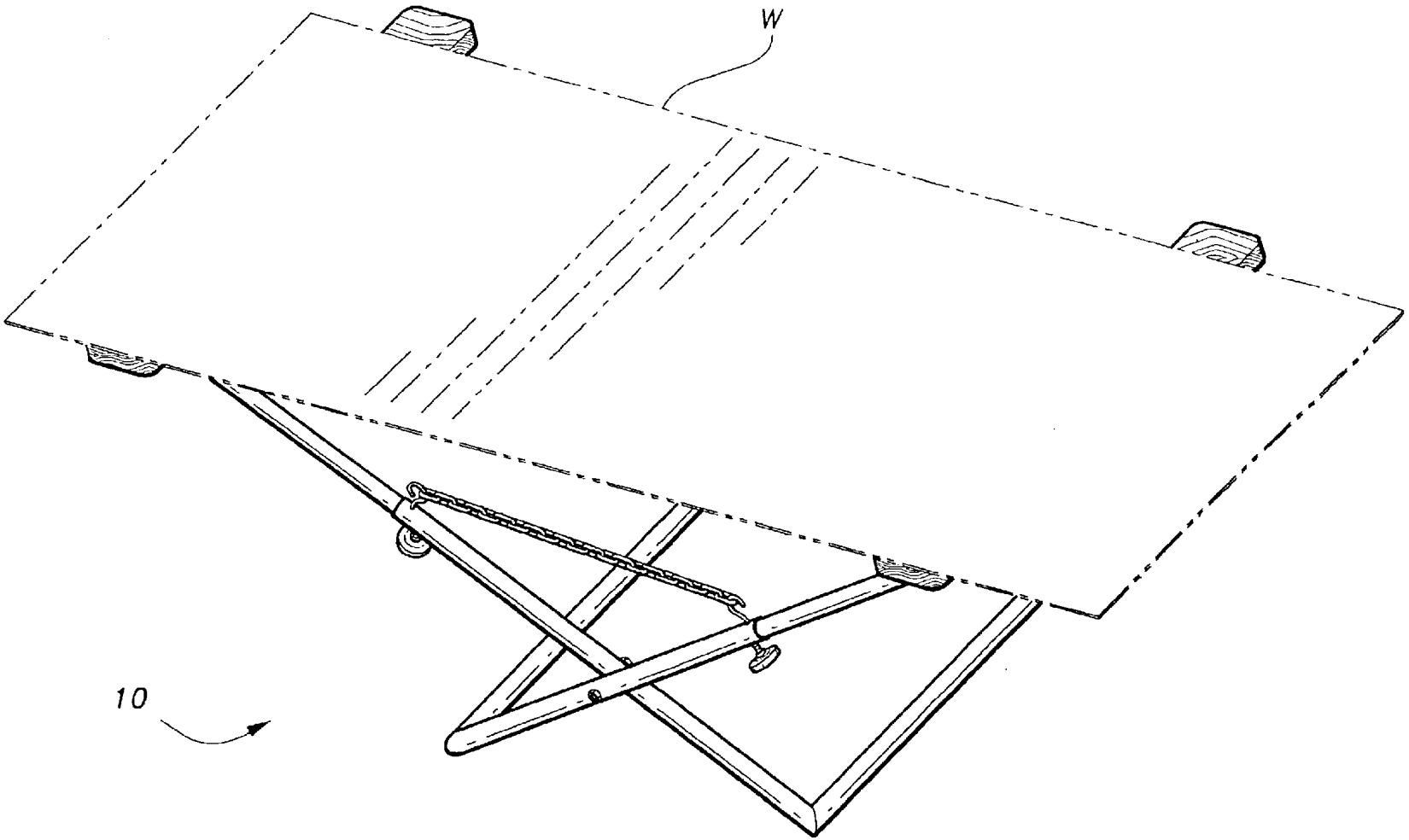
FIG. 1 is an environmental, perspective view of an adjustable sawhorse with two support members according to the present invention supporting a large sheet of plywood.
Figure 2:
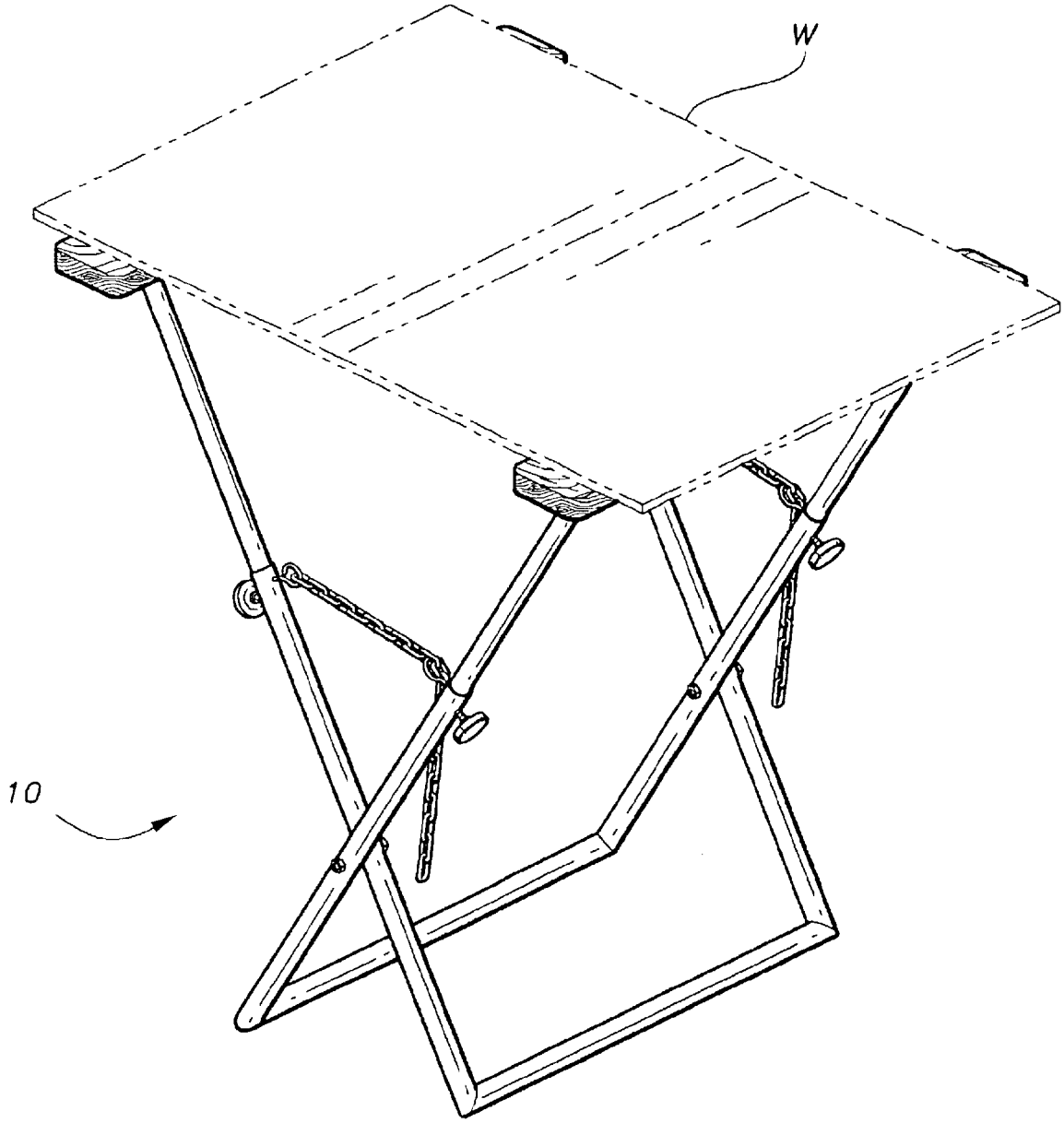
FIG. 2 is an environmental, perspective view of an adjustable sawhorse with two support members according to the present invention supporting a small sheet of plywood.

The present invention is an adjustable sawhorse with two support members designated generally as 10 in the drawings. As shown in the drawings, the invention is comprised of two leg assemblies 11 and 12, two support members 13 and 14, two chains 15 and 16, and four locking knobs 17, 18, 19 and 20.

Figure 7:
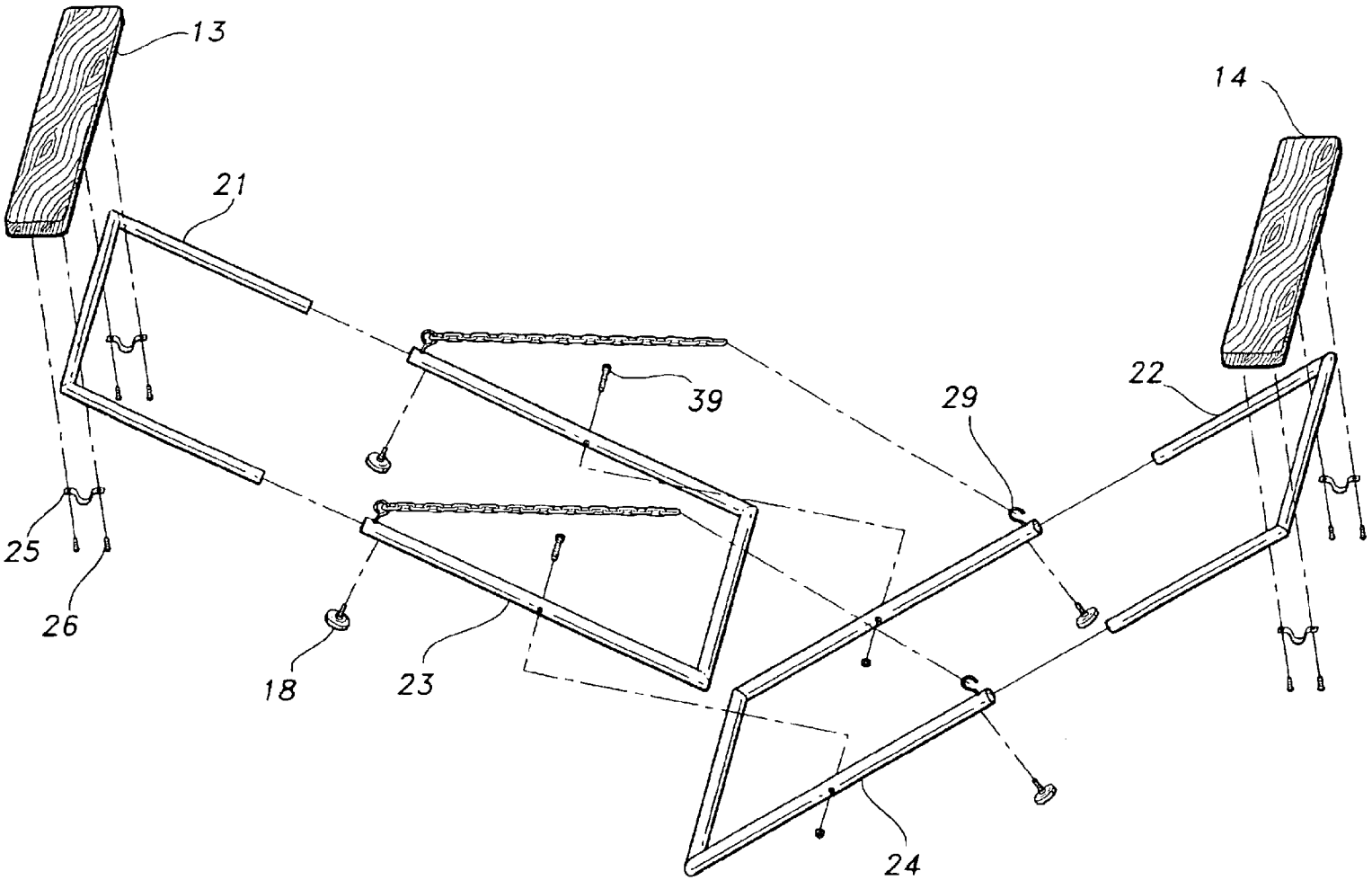
FIG. 7 is an exploded view of an adjustable sawhorse with two support members according to the present invention.
Figure 10:
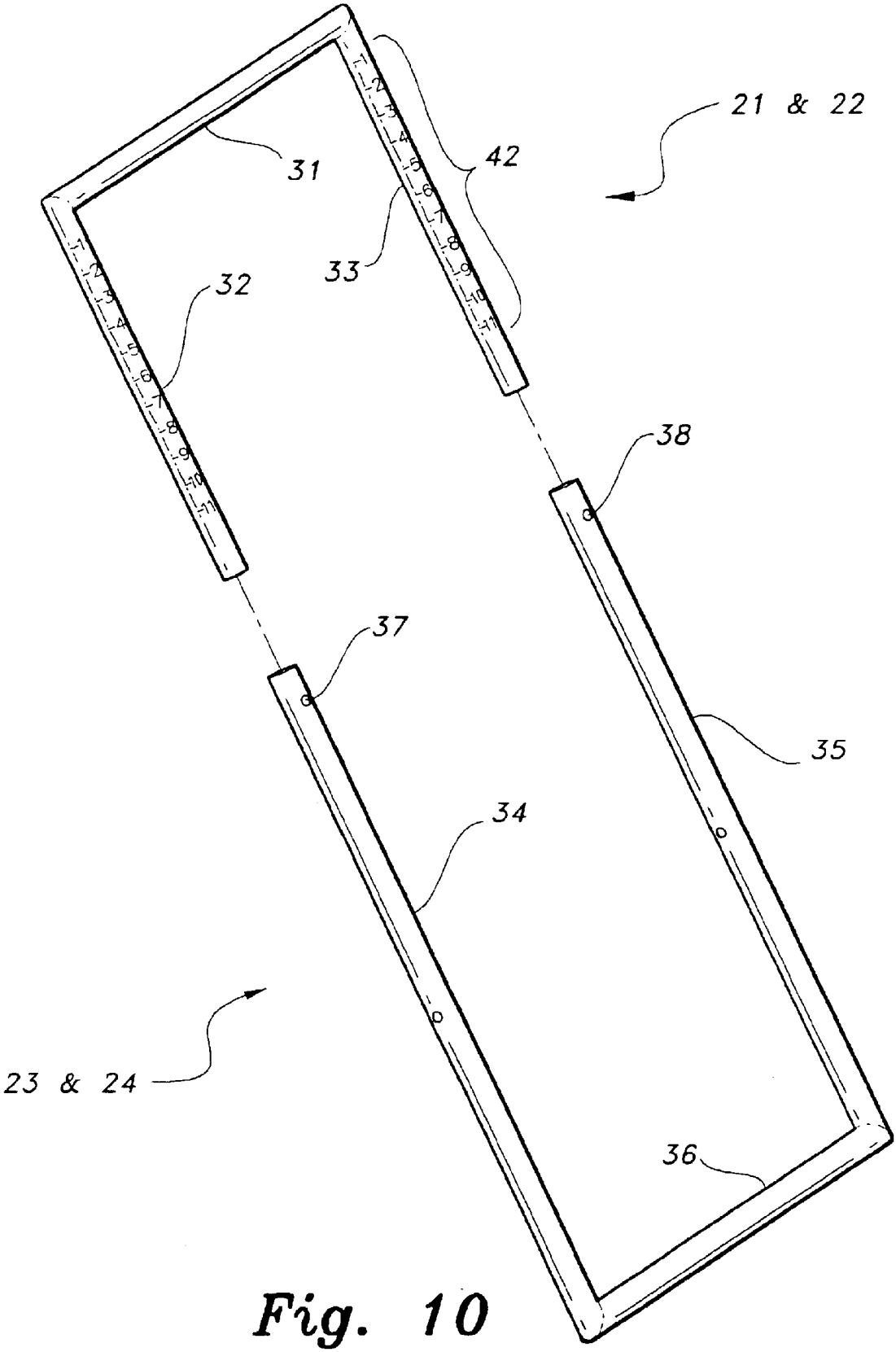
FIG. 10 is a perspective view of an inner and an outer "U" shaped tubular member of an adjustable sawhorse with two support members according to the present invention showing the relationship between the two "U" shaped tubular members.

Each of the leg assemblies 11 and 12 is comprised of one inner "U" shaped tubular member 21 and 22 and one outer "U" shaped tubular member 23 and 24 with each "U" shaped tubular member having two sides 32, 33, 34 and 35 and a cross bar 31 and 36, as shown in FIG. 10. The tubing of each inner "U" shaped tubular member 21 and 22 has a diameter smaller than that of its corresponding outer "U" shaped tubular member 23 and 24. The two sides 32 and 33 of an inner "U" shaped tubular member 21 and 22 slidably push-fit into corresponding sides 34 and 35 of an outer "U" shaped tubular member 23 and 24 to form a rectangular tubular frame 11 and 12. For each leg assembly 11 and 12, the inner and outer "U" shaped tubular members 21, 22, 23 and 24 are locked in place relative to each other by locking knobs 17, 18, 19 and 20. The two leg assemblies 11 and 12 are pivotally attached to each other by two pivot bolts 39, as shown in FIG. 7. The dihedral angles formed by the two leg assemblies 11 and 12 may be increased or decreased by rotating either of the leg assemblies 11 and 12 with respect to the axis of the pivot bolts 39, as illustrated by comparing FIGS. 3 and 4.

Figure 9:
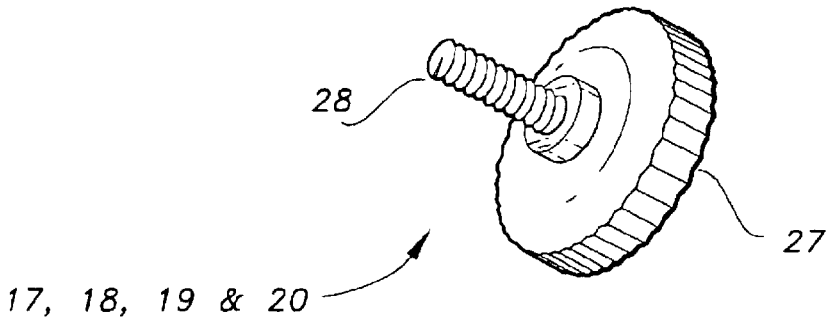
FIG. 9 is a perspective view of a locking knob of an adjustable sawhorse with two support members according to the present invention.

Each of the locking knobs 17, 18, 19 and 20 is comprised of a knob 27 attached to one end of a screw 28, as shown in FIG. 9. Each screw 28 mates to a threaded opening 37 and 38 (shown in FIG. 10) in a side 34 and 35 of an outer "U" shaped tubular member 23 and 24. When the screw 28 is advanced in the threaded opening 37 and 38, by rotating the knob 27, it clamps the inner "U" shaped tubular member 21 and 22 in a fixed position relative to the outer "U" shaped tubular member 23 and 24.

Figure 8:
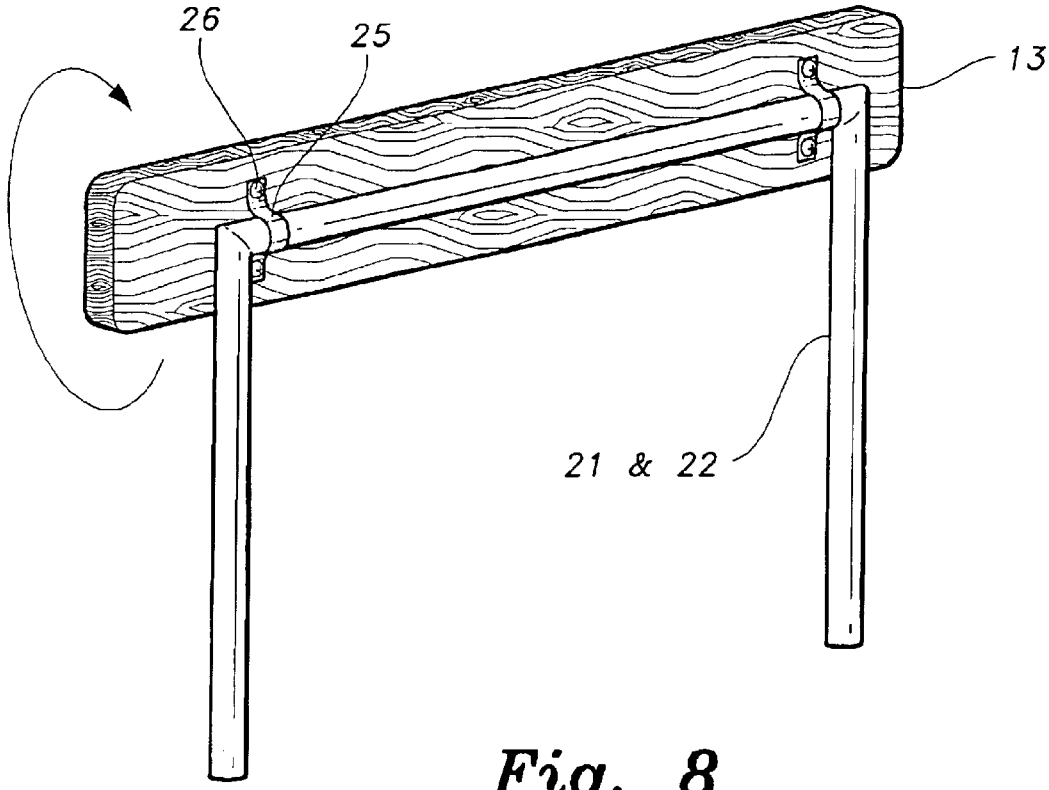
FIG. 8 is a fragmented view of a support member pivotally mounted to a "U" shaped tubular member of an adjustable sawhorse with two support members according to the present invention.

Each of the support members 13 and 14 is pivotally attached to the cross bar 31 of an inner "U" shaped tubular member 21 and 22 by two "U" shaped clamps 25 and four bolts 26, as shown in FIGS. 7 and 8. Each support member 13 and 14 can be rotated relative to the cross bar 31 on which it is mounted by applying modest hand pressure and, therefore, can be positioned horizontally regardless of the angle at which the leg assembly 11 and 12 is positioned. Each support member 13 and 14 is constructed of wood and, if damaged, can be readily replaced with a segment of ordinary two-by-four wood.

Figure 3:
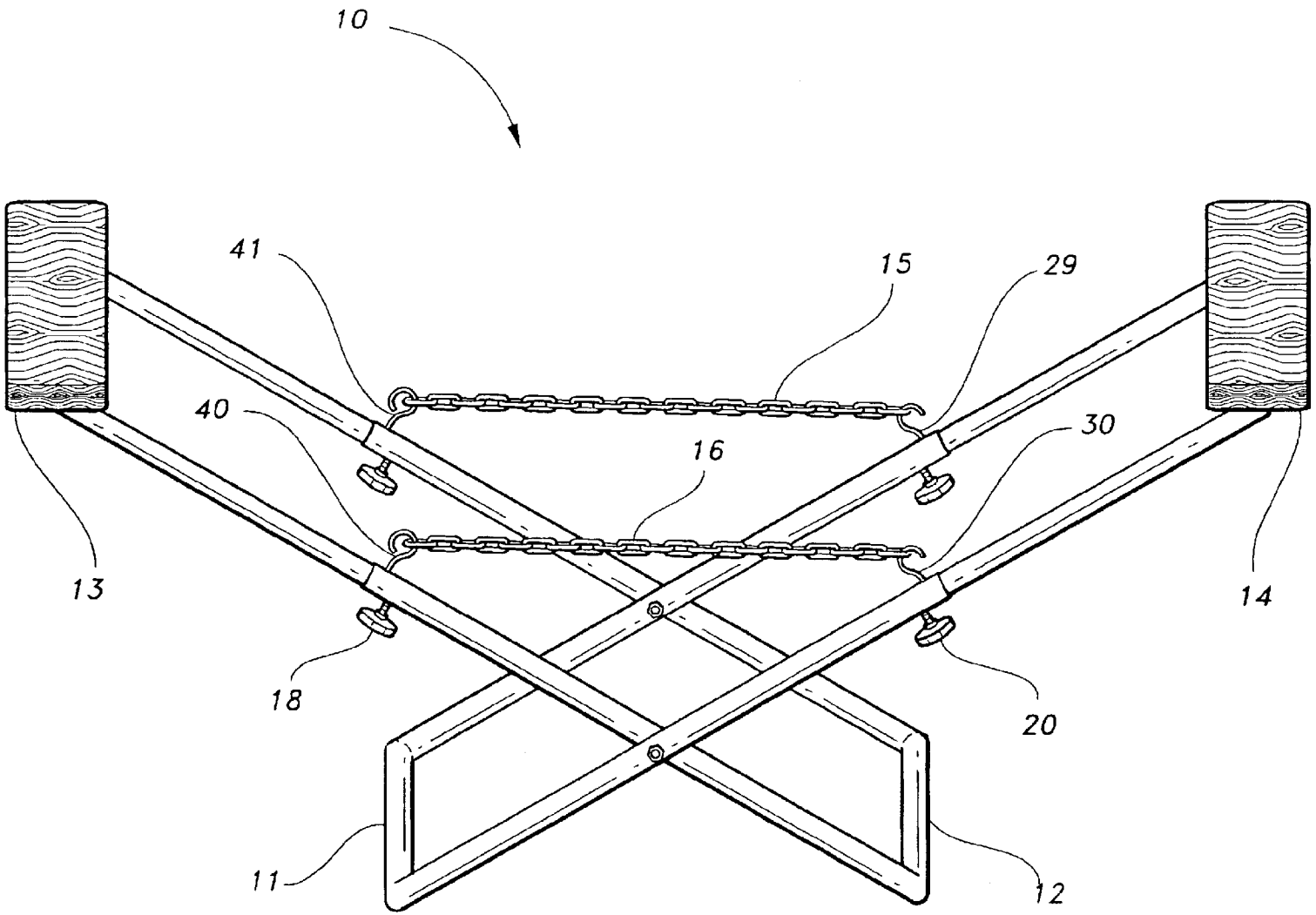
FIG. 3 is a front, perspective view of an adjustable sawhorse with two support members according to the present invention adjusted to a wide and low position.
Figure 4:
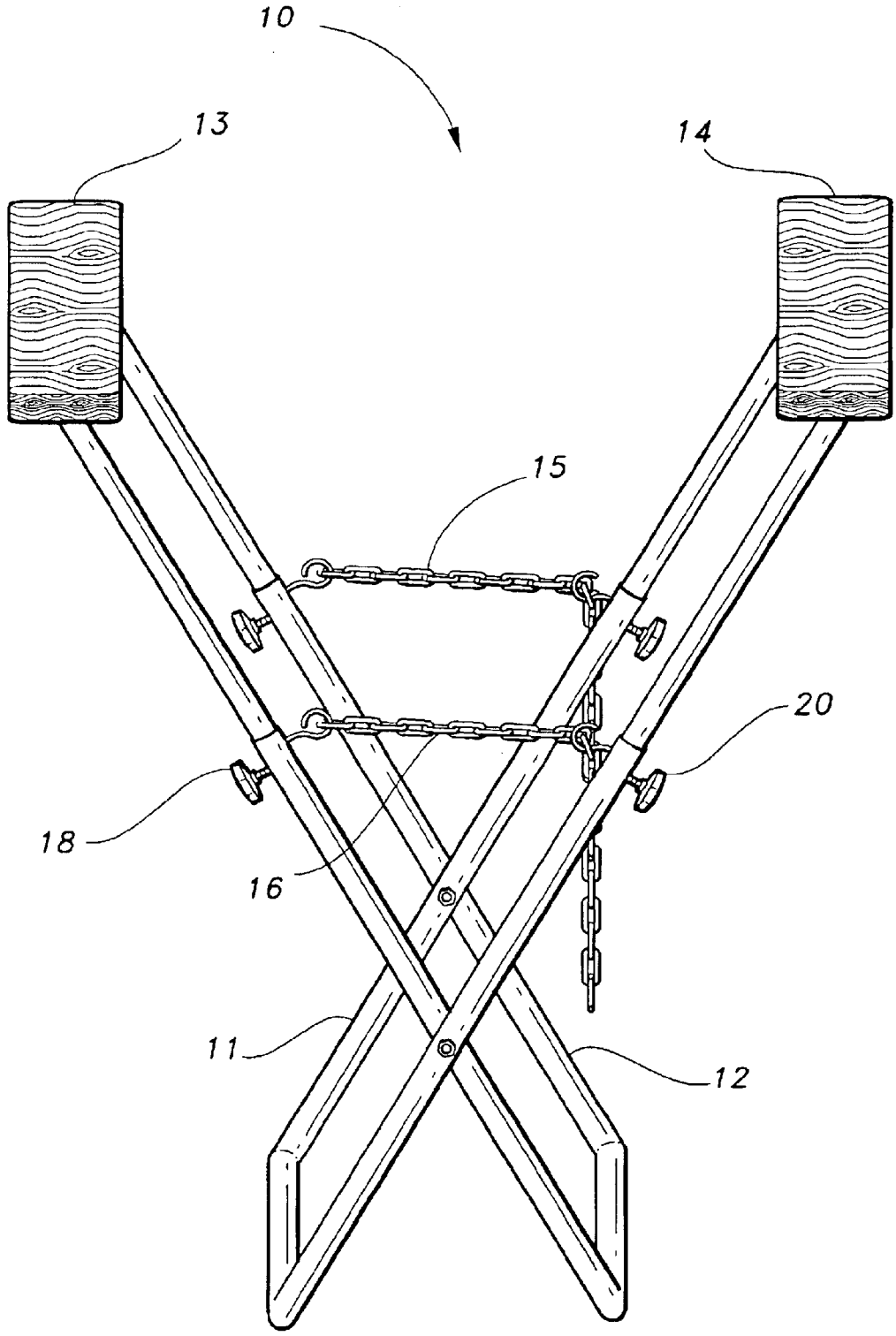
FIG. 4 is a front, perspective view of an adjustable sawhorse with two support members according to the present invention adjusted to a narrow and high position.
Figure 5:
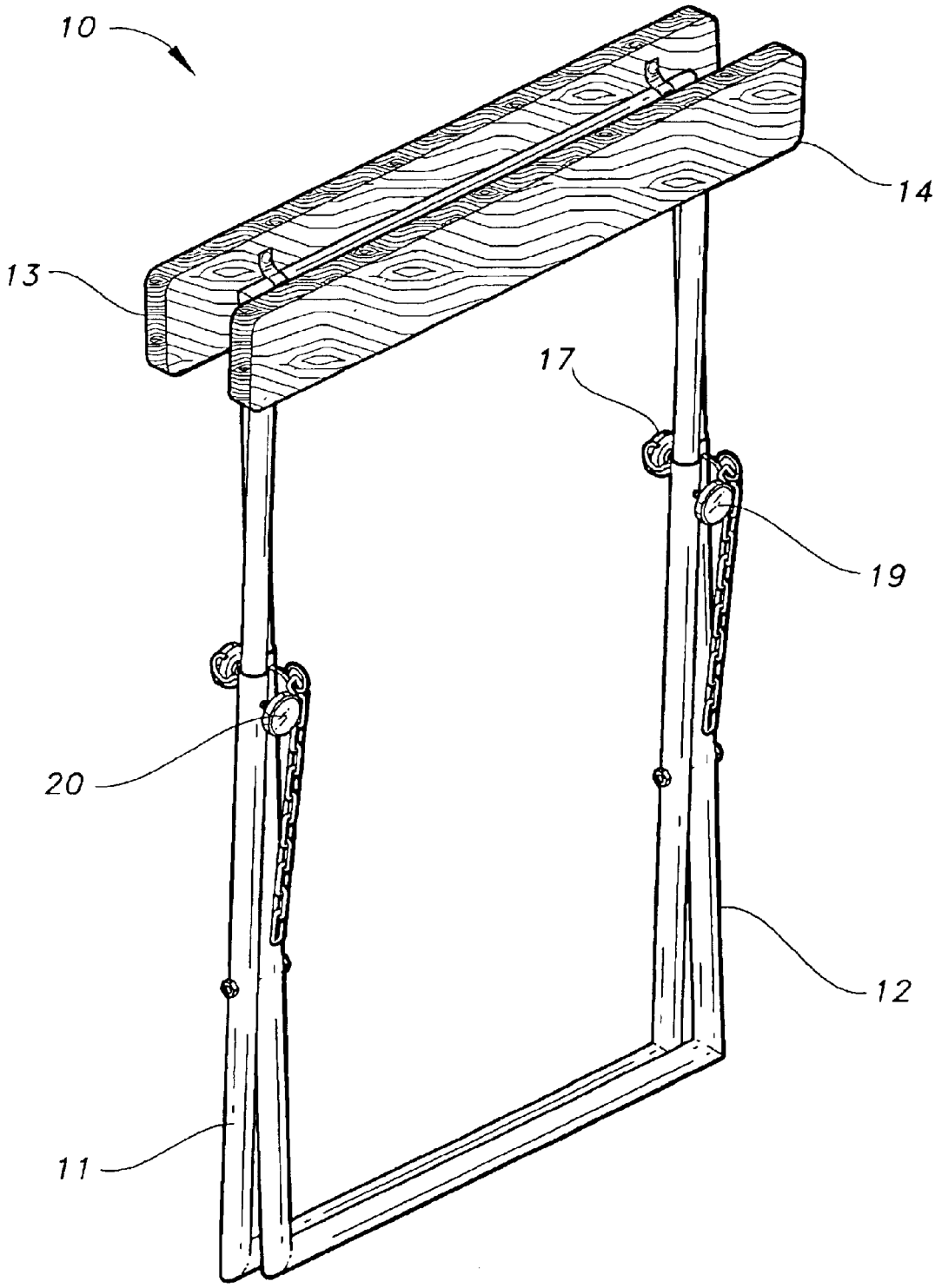
FIG. 5 is a perspective view of an adjustable sawhorse with two support members according to the present invention in a collapsed position.

Each of the chains 15 and 16 is permanently attached to the same outer "U" shaped tubular member 23 by an eye bolt 40 and 41, as shown in FIGS. 3 and 7. More specifically, one end of each chain 15 and 16 is permanently attached to a side of the same "U" shaped tubular member 23, with each side having one chain 15 and 16 attached thereto. The other end of each chain, or any link between the two ends of each chain, may be is attached to each side of the other outer "U" shaped tubular member 24. The length of chain 15 and 16 in tension between each hook 29 and 30 and each eye bolt 40 and 41 determines the dihedral angle between the two leg assemblies and must be substantially equal for the invention 10 to be stable.

The height and width of the invention 10 can be adjusted by either adjusting the length of the interlinking chains 15 and 16 or by adjusting the size of each of the rectangular framed leg assemblies 11 and 12. The length of each chain 15 and 16 that is in tension between a hook 29 and 30 and an eye bolt 40 and 41 is adjusted by first disconnecting the chain 15 and 16 from the hook 29 and 30 and then connecting a different link in the chain 15 and 16 to the hook 29 and 30. The size of each leg assembly 11 and 12 is adjusted by sliding the sides 32 and 33 of the inner "U" shaped tubular member further into or out of the corresponding sides 34 and 35 of the outer "U" shaped tubular member. A series of uniformly spaced lines 42 are marked on the sides 32 and 33 of each inner "U" shaped tubular member 21 and 22, as shown in FIG. 10. The lines 42 allow an individual to easily ensure, for both leg assembly, that the same amount of the inner "U" shaped tubular member 21 and 22 extends from the corresponding outer "U" shaped tubular member 23 and 24 and, thereby, ensure that the leg assemblies 11 and 12 are the same size.

Figure 6:
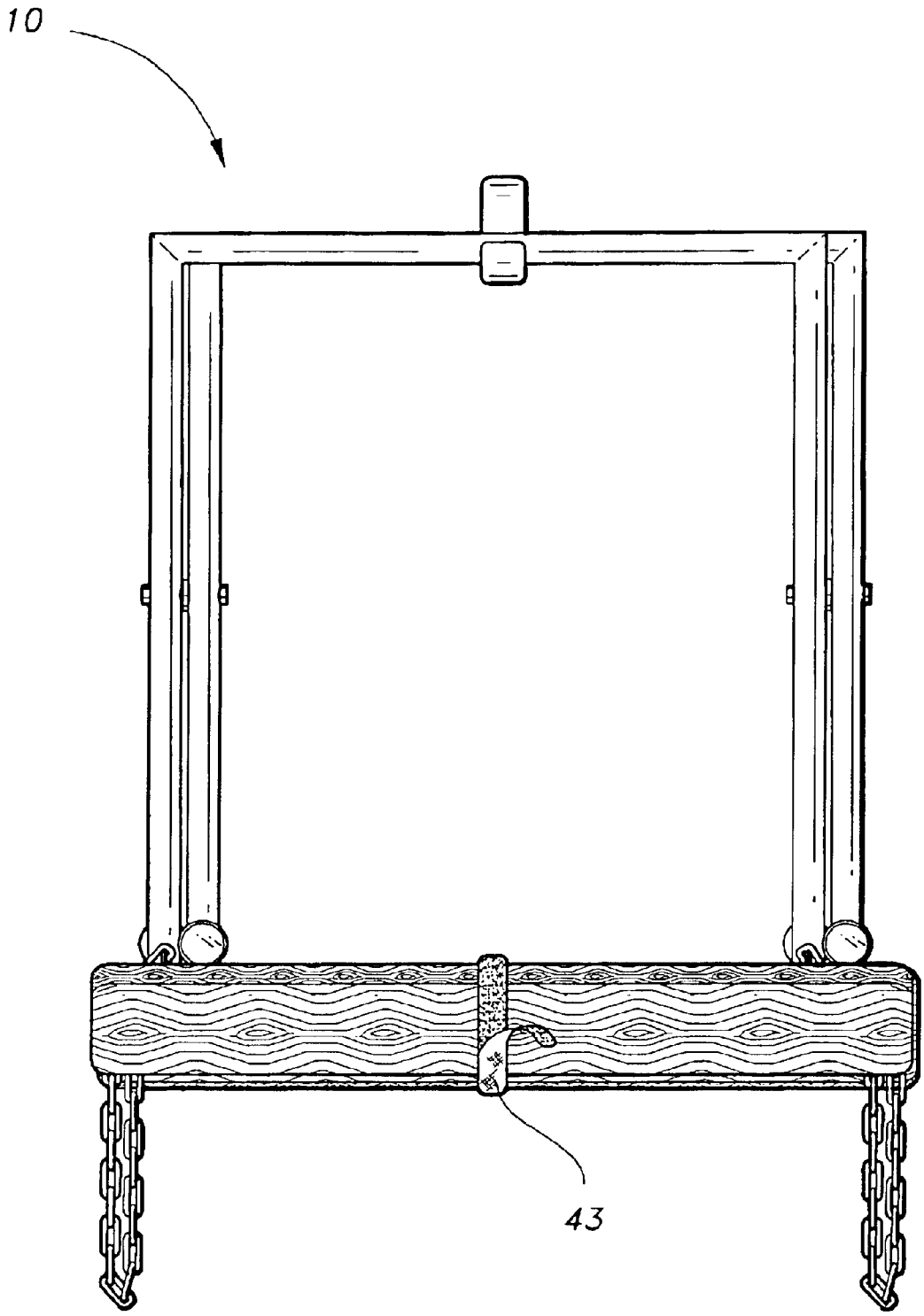
FIG. 6 is an environmental, perspective view of an inverted adjustable sawhorse with two support members according to the present invention in a collapsed position as stored on a hook.

As shown in FIG. 6, a strip of hook and loop fastening material 43 can be wrapped around the support members 13 and 14 to secure the invention 10 in a collapsed position.

FIGS. 1 through 5 illustrate the invention 10 as collapsed, as adjusted to different heights and widths, and as used to support a piece of building material W.

It is to be understood that the present invention is not limited to the embodiment described above, but encompasses any and all embodiments within the scope of the following claims.

I claim:

1. An adjustable sawhorse comprising:

a first leg assembly having two legs and having at least two cross bars;

a second leg assembly having two legs and having at least two cross bars;

a first support member pivotally attached to said first leg assembly;

a second support member pivotally attached to said second leg assembly;

said first leg assembly and said second leg assembly being pivotally attached to each other, each said first leg assemble and said second leg assembly including a first and a second U-shaped tubular member constructed of a continuous piece of tubing formed into two sides and a cross bar;

each of said first U-shaped tubular members having a diameter smaller than that of each of said second U-shaped tubular members;

each of the sides of said first U-shaped tubular member of said first leg assembly slidably push-fits into a corresponding side of said second U-shaped tubular member of said first leg assembly to form a first tubular rectangle, and each of the sides of said first U-shaped tubular member of said second leg assembly slidably push-fits into a corresponding side of said second U-shaped tubular member of said second leg assembly to form a second tubular rectangle;

a first chain having a first end, a second end and a plurality of links; and a second chain having a first end, a second end and a plurality of links;

said first end of each of said first and second chains being attached to said first leg assembly; and said second end or any of said plurality of links of each of said first and said second chains being attachable to said second leg assembly.

2. The adjustable sawhorse according to claim 1 wherein:

said first and said second support members are constructed of wood.

3. The adjustable sawhorse according to claim 1 further comprising:

four locking knobs each having a knob attached to one end of a screw;

wherein each of said locking knobs is mounted to a threaded opening in a side of said second U-shaped tubular members of said first and said second leg assemblies; and wherein, when rotated, each of said locking knobs locks in place one side of one said first U-shaped tubular members relative to one side of one said second U-shaped tubular members.

4. The adjustable sawhorse according to claim 3 further comprising:

a series of markings on each side of each said first U-shaped tubular members;

wherein said markings indicate the length of each side of each said first U-shaped tubular members that is outside of the corresponding side of said second U-shaped tubular members.

5. The adjustable sawhorse according to claim 4 wherein:

said first and said second support members are constructed of wood.

6. The adjustable sawhorse according to claim 5 wherein:

said U-shaped tubular members are constructed of galvanized steel.

7. The adjustable sawhorse device according to claim 6 further comprising:

a fastening strap comprised of hook and loop fastening material;

wherein said fastening strap can be used to fasten a cross bar of said first leg assembly to a cross bar of said second leg assembly.

* * * * *